US006475283B1

(12) United States Patent
Koehn

(10) Patent No.: US 6,475,283 B1
(45) Date of Patent: Nov. 5, 2002

(54) DEVICE FOR APPLYING FORMATTED ADHESIVE APPLICATIONS ON A TRANSFER ROLLER

(75) Inventor: Uwe Koehn, Osnabrueck (DE)

(73) Assignee: Windmoeller & Hoelscher, Lengerich (DE)

( * ) Notice: Subject to any disclaimer, the term of this patent is extended or adjusted under 35 U.S.C. 154(b) by 4 days.

(21) Appl. No.: 09/625,986

(22) Filed: Jul. 26, 2000

(30) Foreign Application Priority Data

Jul. 27, 1999 (DE) ..... 199 35 117

(51) Int. Cl.[7] ..... B05C 1/02; B05C 1/04

(52) U.S. Cl. ..... 118/684; 118/304; 118/313; 118/323; 118/325

(58) Field of Search ..... 118/304, 684, 118/313, 323, 325; 427/207.1; 156/578

(56) References Cited

U.S. PATENT DOCUMENTS 5,679,162 A * 10/1997 Caffrey et al. ..... 118/684

6,284,043 B1 * 9/2001 Takekuma ..... 118/52

FOREIGN PATENT DOCUMENTS

| | | |
|---|---|---|
| DE | 42 08 564 | 9/1993 |
| DE | 196 34 594 | 3/1998 |
| DE | 197 14 029 | 10/1998 |
| DE | 197 44 036 | 4/1999 |
| FR | 2 329 354 | 5/1977 |

* cited by examiner

*Primary Examiner*—Laura Edwards
(74) *Attorney, Agent, or Firm*—Jacobson Holman PLLC

(57) ABSTRACT

A device for applying adhesive applications on an addhesive transfer roller. The adhesive transfer roller delivers through a process of roling off its adhesive aplications to workpieces that are fed continuously for the purpose of gluing. To apply the formatted adhesive applicationm in a simple and clean manner on the transfer roller, there are, in addition to the transfer roller, adhesive nozzles that are spaced axially equidistant apart and are aimed against the jacket of the transfer roller. The adhesive application nozzles are provided with valves whose opening and closing times are controlled individually by a controller for the purpose of producing formatted adhesive applications.

18 Claims, 2 Drawing Sheets

DEVICE FOR APPLYING FORMATTED ADHESIVE APPLICATIONS ON A TRANSFER ROLLER

BACKGROUND OF THE INVENTION

1. Field of the Invention

The invention relates to a device for applying formatted adhesive applications on a transfer roller, which delivers through a process of rolling off its adhesive applications to workpieces, which are fed continuously for the purpose of covering with adhesive.

2. Description of the Related Art

Such adhesive applicators already exist in various embodiments. They usually consist (see, for example DE 196 34 594 A1) of one or two adhesive rollers, which are positioned at the opening edges of a housing, enveloping an adhesive chamber, and close said housing and which deliver their adhesive applications to a transfer roller. Almost the entire area of the transfer roller can be provided with adhesive applications; or the transfer roller can be provided with blocks, which receive and transfer the formatted adhesive applications as a function of their shape. The drawback of such prior art adhesive applicators lies in the fact that, as the format(s) of the adhesive applications change(s), the transfer roller bearing the blocks must also be changed. Furthermore, with the prior art adhesive applicators the adhesive cannot be prevented from escaping continuously from said adhesive applicators so that the adhesive has to be collected and drained off or recirculated. Furthermore, it is necessary to clean the prior art adhesive applicators regularly, a process that is quite time consuming.

SUMMARY OF THE INVENTION

Therefore, the object of the invention is to provide an adhesive applicator of the class described in the introductory part that makes it possible to modify the adhesive formats easily and quickly; and its simple design eliminates the need to clean, since it works in a virtually maintenance free manner.

The invention solves this problem in that, in addition to the transfer roller, there are adhesive nozzles that are spaced axially equidistant apart and are aimed against the jacket of the transfer roller and are provided with valves whose opening and closing times are controlled individually by a controller.

With the adhesive applicator of the invention arbitrary formats of adhesive applications can be sprayed on the transfer roller through suitable control of the adhesive nozzles. If the device is adjusted in such a manner that all of the sprayed on adhesive applications are delivered from the transfer roller to the workpieces, then it is possible to operate the device more cleanly and virtually maintenance free.

It is possible for adhesive applicator nozzles, which are arranged side by side, not to apply a continuous adhesive application, thus an adhesive application, which does not comprise parallel strips, even if the strip shaped adhesive applications that are sprayed on the transfer roller are spread out, during the transfer process, on the workpieces to be covered with glue, for example a web that is travelling by. Therefore, another embodiment of the invention provides that a row of adhesive nozzles is mounted on a support, which moves the row parallel to the axis of the transfer roller by means of a controller. In so doing, the adhesive nozzles can be controlled in such a manner as a function of the format to be generated on the transfer roller that during each revolution each of the adhesive nozzles used for the format to be produced applies a circumferential strip of the required length on the transfer roller; and during the next revolution an adjustment in the axial direction takes place in such a manner that the next adhesive application is applied between the previously produced adhesive applications. In this operating mode it can be assumed that in each cycle the transfer roller delivers only a part of the adhesive strips to be sprayed on to the passing web or the passing workpieces so that the adhesive is always transferred over the entire area in accordance with the formats.

It is advantageous for the adhesive nozzles to be spaced so far apart from each other that the distance is equivalent to twice the width of the adhesive track to be applied by the same. Hence the adhesive nozzles can be slid back and forth by the width of one adhesive track in time with one revolution of the transfer roller. In this operating mode each adhesive track is applied only in every second revolution of transfer roller so that, as a function of the number of adhesive nozzles in operation and the circumferential lengths of the adhesive tracks to be produced through suitable control, any arbitrary size of adhesive applications to be applied over the whole area can be applied on the transfer roller.

The arrangement of suitably spaced adhesive nozzles also accounts for the circumstance that the adhesive nozzles are very expensive so that even for the purpose of applying adhesive over the entire area in accordance with a specific format only an equivalently reduced number of adhesive nozzles is necessary.

If at the start of the operation no waste is to be produced in such a manner that the first application is not over the entire area but only in strips, the control can take place in such a manner that two revolutions of the transfer roller result in an application of adhesive that covers the entire area according to the format before said adhesive application is received by the passing webs or workpieces.

It is also possible to apply adhesive applications over the whole area by means of another strip pattern. For this reason another embodiment provides that the adhesive nozzles are spaced apart multiple times the width of the adhesive tracks to be applied by said adhesive nozzles and can be moved forward by the width of one adhesive track in a number of these multiple corresponding steps in time with the revolutions of the transferroller and preferably back again in one step.

It is advantageous for the control of the adhesive nozzles to comprise a microcomputer controller. The images of the formatted adhesive applications can be put into a storage (bit map) of an appropriate computer, which controls the opening and closing times of the adhesive applicator nozzles for the purpose of applying adhesive according to a specific format.

A preferred embodiment of the invention provides that the adhesive nozzles are mounted on an elongated support, which can be moved step by step in any direction in time with the revolution of the transfer roller in guides of the machine frame by means of a driver, e.g. a pressure medium piston cylinder unit. With this sliding unit the pattern of the adhesive tracks to be produced during successive revolutions can be controlled.

BRIEF DESCRIPTION OF THE DRAWINGS

One embodiment of the invention is explained in detail below with reference to the drawings.

DETAILED DESCRIPTION OF THE PREFERRED EMBODIMENTS

Figure 1:
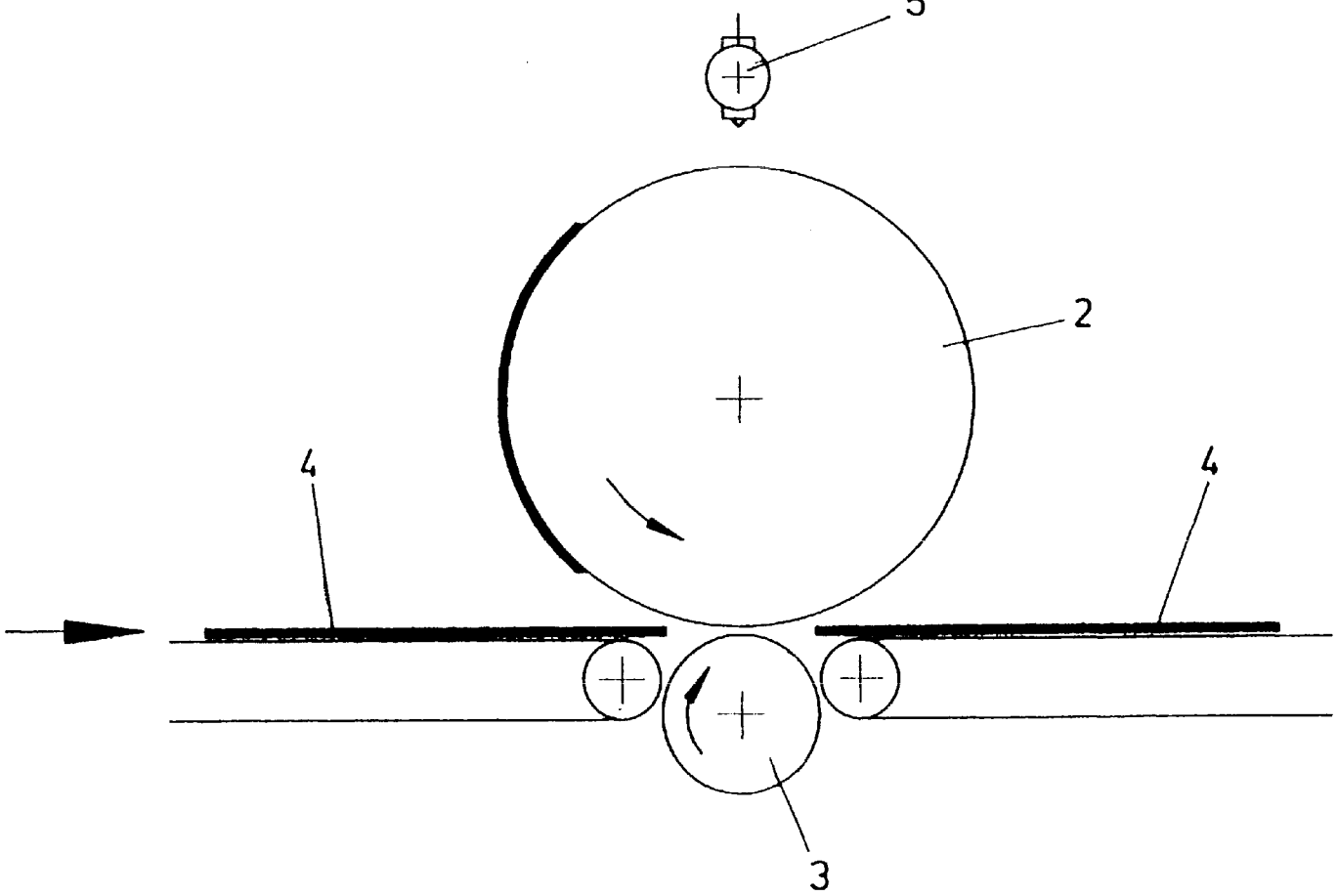
FIG. 1 is a schematic drawing of a side view of the adhesive applicator of the invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The adhesive applicator comprises an adhesive transfer roller 2, which is pivot mounted in a machine frame 1 and provided with a drive (not illustrated). Below the adhesive transfer roller 2 the counter pressure roller 3, which can also be provided with a drive, is mounted on the machine frame. Between the adhesive transfer roller 2 and the counter pressure roller 3 passes a web or workpieces 4, to be provided with formatted adhesive applications, which are to be glued and are spaced specific distances apart. The workpieces 4 are conveyed in the direction of the arrow by suitable conveyors, for example belt conveyors.

Above the adhesive transfer roller 2 is mounted in the machine frame an elongated support 5, along which there is a row of adhesive applicator nozzles 6, spaced equidistant apart. Said row is parallel to the axis of the adhesive application roller 2. The adhesive nozzles 6 are fed individually by a supply line (not illustrated). The valves of the individual adhesive applicator nozzles 6 are controlled by a computer 7 over control lines 8. Said computer is provided with a storage, in which the patterns of the formatted adhesive applications 9 are deposited.

The bar shaped support 5, supporting the individual adhesive applicator nozzles 6, cannot be rotated, but can be slid axially by end sided axle journals 10 in sliding sleeves of the frame 1. To slide the support 5 back and forth there is a pressure medium piston cylinder unit 11, which is driven back and forth in accordance with the image to be produced of the formatted adhesive application 9 by the computer 7 using a control valve 12.

The adhesive applicator nozzles 6 and the support 5 supporting said nozzles are controlled by the computer 7 in such a manner that the adhesive applicator nozzles apply glue tracks a on the adhesive transfer roller during a first revolution of said adhesive transfer roller 2 and then following axial adjustment of the support 5 by the width of one glue track apply inbetween glue tracks b of a length that is equivalent to the formatted application to be produced.

Figure 2:
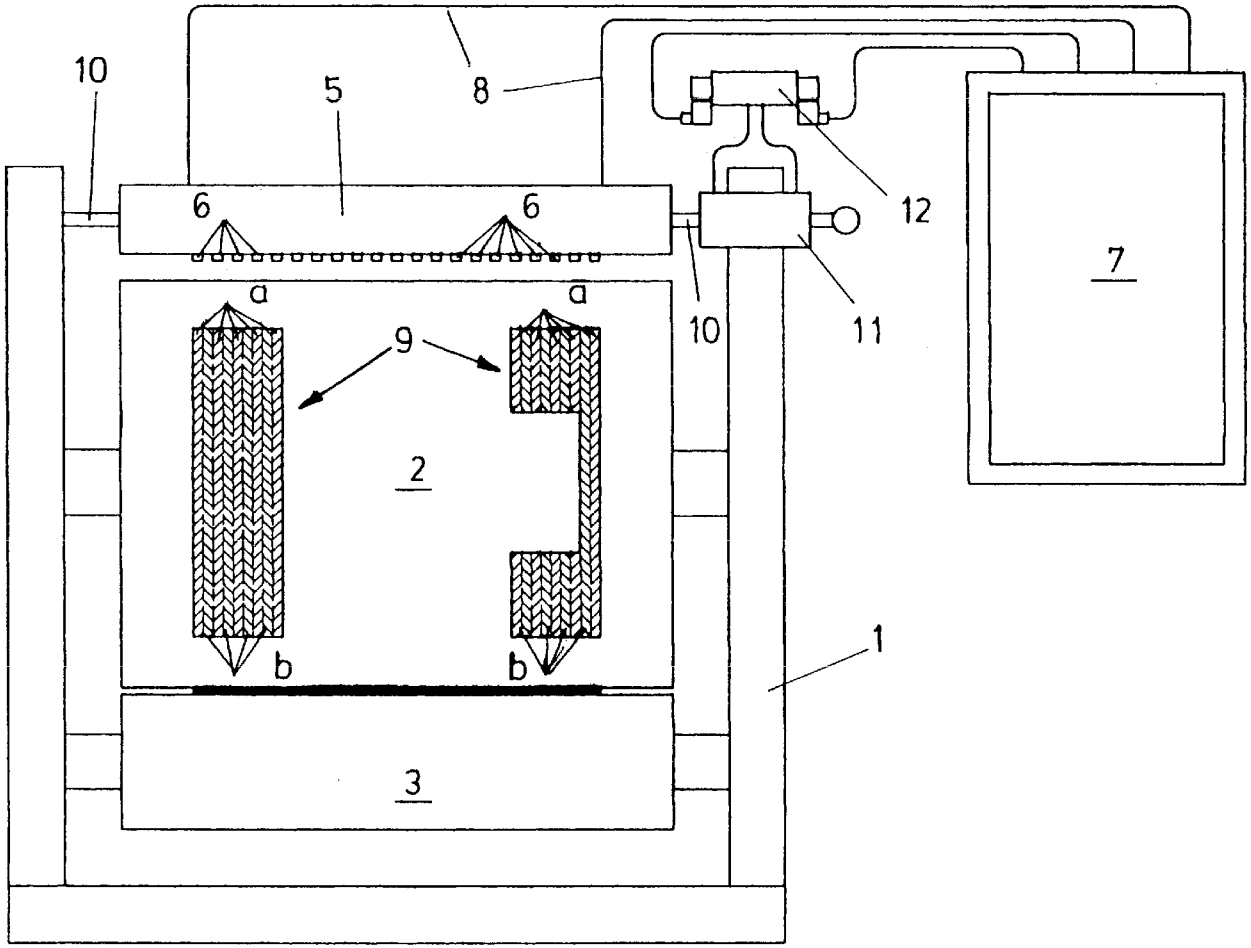
FIG. 2 is a front view of the adhesive applicator according to FIG. 1.

At the start of the operation the formatted adhesive application, as shown in FIG. 2, is applied during two revolutions. Then the glue tracks a and b are applied in successive revolutions so that each passing workpiece 4 to be glued takes over a fresh track of glue and the rest of a glue track applied in the previous revolution.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

Since the workpiece to be glued does not accept all of the adhesive from the adhesive transfer roller during the rolling off process, it suffices for the purpose of the formatted application of adhesive over the entire surface of the workpieces to be glued that individual glue tracks be applied only in the described alternating procedure.

For specific applications it can suffice to transfer only formatted adhesive applications that exhibit a strip shaped pattern with adhesive free strips between the individual adhesive tracks. If, however, the bottoms of sacks are to be provided, for example, with formatted adhesive applications, it is usually necessary to apply the adhesive over the entire area in order to avoid the generation of dripping channels.

What is claimed is:

1. A device for applying formatted adhesive applications on a transfer roller, which delivers through a process of rolling off adhesive applications to workpieces or webs, fed continuously for gluing, which comprises a plurality of adhesive nozzles that are spaced axially equidistant apart and are aimed toward the transfer roller, said adhesive nozzles being provided with valves whose opening and closing times are controlled individually by a controller having a bit map storage for storing images of a plurality of formatted adhesive applications, said controller opening and closing said valves to apply adhesive according to a specific formatted adhesive application.

2. The device as claimed in claim 1, wherein a row of adhesive nozzles is mounted on a support which moves the row substantially parallel to a longitudinal axis of the transfer roller by means of said controller.

3. The device as claimed in claim 1, wherein the adhesive nozzles are spaced at a distance from each other that is approximately twice a width of an adhesive track to be applied by each nozzle, said adhesive nozzles able to slide back and forth by the width of one adhesive track in time with one revolution of the transfer roller.

4. The device as claimed in claim 1, wherein the adhesive nozzles are spaced apart from each other at a distance that is multiple times a width of an adhesive track to be applied by said adhesive nozzles and can be moved forward by the width of one adhesive track in a corresponding number of multiple steps in time with revolutions of the transfer roller.

5. The device as claimed in claim 1, wherein the adhesive nozzles are mounted on an elongated support which is substantially parallel with a longitudinal axis of said transfer roller and can be moved back and forth along said axis in time with revolution of the transfer roller by means of a driver.

6. The device as claimed in claim 5, wherein said driver is a pressure medium piston cylinder unit.

7. A device for applying formatted adhesive applications on a transfer roller which rolls off adhesive applications to workpieces or webs that are fed continuously along the transfer roller for gluing, which comprises a row of adhesive nozzles spaced axially and approximately equidistantly from one another and mounted on a support which moves said row of nozzles substantially parallel to a longitudinal axis of said transfer roller, said adhesive nozzles being aimed toward the transfer roller and being individually opened and closed by a controller.

8. The device as claimed in claim 7, wherein the adhesive nozzles are spaced at a distance from each other that is approximately twice a width of an adhesive track to be applied by each nozzle, said adhesive nozzles able to slide back and forth by the width of one adhesive track in time with one revolution of the transfer roller.

9. The device as claimed in claim 7, wherein the adhesive nozzles are spaced apart from each other at a distance that is multiple times a width of an adhesive track to be applied by said adhesive nozzles and can be moved forward by the width of one adhesive track in a corresponding number of multiple steps in time with revolutions of the transfer roller.

10. The device as claimed in claim 7, wherein the controller has a bit map storage for storing images of a plurality of formatted adhesive applications, the controller opening and closing said nozzles to apply adhesive according to a specific formatted adhesive application.

11. The device as claimed in claim 7, wherein said support is an elongated member and can be moved back and forth substantially parallel with said longitudinal axis in time with revolution of the transfer roller by means of a driver.

12. The device as claimed in claim 11, wherein said driver is a pressure medium piston cylinder unit.

13. A device for applying formatted adhesive applications on a transfer roller which rolls off adhesive applications to workpieces or webs that are fed continuously along the transfer roller for gluing, which comprises a row of adhesive nozzles aimed toward the transfer roller and spaced axially from one another at a distance which is at least twice a width of an adhesive track to be applied by each nozzle, said nozzles being individually opened and closed by a controller and being slid back and forth by the width of at least one adhesive track in time with one revolution of said transfer roller.

14. The device as claimed in claim 13, wherein the distance between said adhesive nozzles is approximately twice the width of the adhesive track to be applied by each nozzle.

15. The device as claimed in claim 13, wherein the distance between said adhesive nozzles is multiple times the width of the adhesive track to be applied by each nozzle, and can be moved forward by the width of one adhesive track in a corresponding number of multiple steps in time with revolutions of the transfer roller.

16. The device as claimed in claim 13, wherein the controller has a bit map storage for storing images of a plurality of formatted adhesive applications, the controller opening and closing the nozzles to apply adhesive according to a specific formatted adhesive application.

17. The device as claimed in claim 13, wherein said adhesive nozzles are mounted in a row on an elongated support which moves the row back and forth substantially parallel to a longitudinal axis of the transfer roller.

18. The device as claimed in claim 13, wherein said elongated member is moved back and forth by a pressure medium piston cylinder unit.

* * * * *